US005224662A

United States Patent [19]

Kaussen

[11] Patent Number: 5,224,662

[45] Date of Patent: Jul. 6, 1993

[54] WINDING DRUM FOR A CHAIN STRAND

[75] Inventor: Winfried Kaussen, Aachen, Fed. Rep. of Germany

[73] Assignee: Contiweiss Weissenfels GmbH & Co. Kommanditgesellschaft, Aachen, Fed. Rep. of Germany

[21] Appl. No.: 786,513

[22] Filed: Nov. 1, 1991

[30] Foreign Application Priority Data

Jul. 19, 1991 [DE] Fed. Rep. of Germany ... 9108917[U]

[51] Int. Cl.[5] ..... B65H 49/18; B65H 59/02

[52] U.S. Cl. ..... 242/129.8; 242/99; 242/129.51; 242/156

[58] Field of Search ..... 242/129.8, 99, 156, 242/55.2, 55.53, 129.51, 75.4, 68.4, 129.5, 106

[56] References Cited

U.S. PATENT DOCUMENTS

| | | | |
|---|---|---|---|
| 923,867 | 6/1909 | Luethy | 242/129.51 |
| 3,771,743 | 11/1973 | DeLuca et al. | 242/129.8 |
| 4,541,586 | 9/1985 | Crowe | 242/129.8 X |
| 4,741,493 | 5/1988 | Schaiewitz | 242/129.8 |
| 4,776,527 | 10/1988 | Prowant | 242/129.51 X |
| 4,948,064 | 8/1990 | Richard | 242/129.8 X |

*Primary Examiner*—Stanley N. Gilreath
*Attorney, Agent, or Firm*—McAulay Fisher Nissen Goldberg & Kiel

[57] ABSTRACT

In a winding drum for a chain strand, which is mounted in a support frame by means of a mounting support device so as to be rotatable relative to the latter and which has a central winding shaft, lateral butting rings and on either side a central receptacle for the support device, the latter comprises a shaped plug, which can be non-positively brought into plug connection with the receptacle and with which, in its plugged-in position on rotating the winding drum, with respect thereto, in frictionally resistant manner, a brake torque can be applied to the drum. The plug has a shaped portion projecting axially over the butting ring towards the support frame and also has a non-rotationally symmetrical outer profile for the non-rotary mounting in the support frame.

15 Claims, 1 Drawing Sheet

WINDING DRUM FOR A CHAIN STRAND

BACKGROUND OF THE INVENTION

The invention relates to a winding drum for a chain stand, which can be mounted by means of a supporting device in a support frame so as to be rotatable relative to the device. The winding drum has a central winding shaft and lateral butting rings. Each butting ring has a receptacle formed therein which receives a one end of a plug. Each plug has a shaped end of which is inserted within a support opening of a support device, the support device preventing rotation of the plug. The drum is supported by the plugs and support device and is rotatable with respect to the plug.

Winding drums of the above type are used when chains are sold. Usually several such winding drums hang together in a support frame and different chains are generally wound onto them. The winding drums are generally suspended on the support frame by means of rods passed through their hollow winding shaft. The external diameter of these rods is normally much smaller than the internal diameter of the winding shaft, so as, on the one hand, to avoid fitting problems between the winding shaft and the passed-through rod and, on the other hand, to ensure easy removal of the chain from the drum. This free rotation, however, suffers from the disadvantage that, on pulling on the chain for unwinding it, the winding drum continues to rotate due to its own mass moment of inertia and its filling when the pull on the winding drum is ended. This results in the unwinding of a longer than desired chain portion. This can even lead to the unwound chain dropping onto the floor, where it may become dirty or intermeshed with the chain of the adjacent drum in the support frame. In any case the extra chain length unwound must be rewound onto the winding drum. This is practically unavoidable in the case of conventional winding drums and the risk of dirtying or damage is considerable.

OBJECT OF THE PRESENT INVENTION

The primary task of the invention is to obviate this difficulty of prior devices and to further develop a winding drum of the aforementioned type so that a much better controlled delivery of the chain to be unwound is possible, while providing an easily and rapidly fittable or removable mounting support for the winding drum on the support frame.

SUMMARY OF THE PRESENT INVENTION

In the case of a winding drum of the aforementioned type, according to the invention, this is achieved by a shaped plug having one end inserted into the central receptacle of each butting ring of the drum. The other end of the plugs is inserted into a support opening of a support frame. The shape of the end inserted in the support frame is such that it prevents the plug from rotating with respect to the frame. The drum is rotatable with respect tot he plugs. The inserted end of the plug, however, applies a frictionally resistant brake torque to the winding drum which prevents the unintended rotation of the drum.

As a result of the inventive use of, in each case, one shaped plug on each side of the winding drum and which is non-positively and frictionally resistantly rotatable with the said drum, but does not itself rotate as a result of the mounting support in the support frame, during the drum rotation process an appropriate braking action is continuously exerted thereon. This, on the one hand, permits a rotation of the winding drum with respect to the shaped plug without excessive force expenditure, while on the other hand, if pull on the chain to be unwound is ended and consequently the external driving torque acting on the drum disappears, the runout rotation caused by the mass moment of inertia of the winding drum and its filling stops in a very short time. As a result, only a very small extra chain portion is unwound and, consequently, an easily controllable delivery during chain unwinding is made possible.

The shaped portion of each shaped plug projecting axially away from the butting ring towards the support frame in the longitudinal direction of the winding drum axis creates a simply and rapidly producible or removable support possibility for the winding drum on the support frame, in that the same is merely hung by means of these shaped portions of the two shaped plugs in corresponding support openings on the support frame or introduced in some other way. As a result of the non-rotationally rotationally symmetrical shaping of the outer profile of the shaped portions of both shaped plugs, the winding drum can be mounted in non-rotary manner on the support frame in corresponding support receptacles.

Any appropriate material can be used for the shaped plugs, it merely being necessary to ensure that, in conjunction with the material of the winding drum, appropriate friction/sliding material pairs are chosen, so as to give the desired, predeterminable magnitude of the braking torque on rotating the winding drum. Plastic and, in particular, thermoplastics have proved particularly suitable as the shaped plug material. This offers the possibility of an inexpensive, but highly functional construction of the shaped plugs. To simplify storage and to minimize the multiplicity of parts, the shaped plugs for each side of the winding drum are appropriately given the same shaping.

According to a preferred further development of the inventive winding drum, the receptacles are in each case made in a circular or ring shoulder on each butting ring. Particularly appropriately, the circular shoulder on the butting ring projects towards the winding drum and, in this case the advantageously tubular drum is externally mounted on the circular shoulder until it engages on the side wall of the butting ring. The shaped plug is inserted from the outside into the central receptacle of the circular shoulder, i.e., from the butting ring side remote from the winding drum.

The shaped plug part cooperating with the receptacle can be given any appropriate shaping, which ensures a suitable non-positive and frictionally resistant connection of the plug with the receptacle. Preferably axial, elastically resilient tongues are formed on the shaped plug and, by means of these tongues, it can be non-positively inserted in the circular shoulder opening.

According to a favorable further development of the invention, the tongues are constructed in the form of circular ring portions in a sectional plane at right angles to the bolt center axis, which leads to an admittedly not uninterrupted circular shoulder. Preferably, there are four individual tongues uniformly distributed around the circumference.

Advantageously, the axially directed tongues are made radially and elastically resilient, so that, on bending, the tongues in the plugging position of the shaped plugs a radially acting, frictional contact-producing spring tension is built up. It has proved particularly advantageous to have four tongues reciprocally displaced by in each case 90° and, between the individual tongues, there is preferably only a small gap of approximately 1 to 3 mm in the case of an external diameter of the tongue ends of approximately 25 to 30 mm.

Thus, each tongue extends roughly over a quadrant, so that the tongues also have an adequate stability in the radial direction to avoid excessively easy bending. Through an appropriate choice of the number and design of the elastic tongues, a desired braking torque can be achieved on the winding drum.

In an advantageous further development of the invention, the external diameter of the free ends of the resilient tongues in the non-inserted state is made somewhat larger than the internal diameter of the circular shoulder. As the tongues can spring elastically radially outwards, on inserting them in the circular shoulder, they are somewhat radially deformed, so that the shaped plug is located with circumferentially distributed pressure in the opening of the circular shoulder.

For limiting the insertion path, the tongues are advantageously located on a circular collar, which projects radially over the external diameter of the tongues and separates them from the shaped portion, which simultaneously serves as a grip or handle for inserting the plug in the winding drum.

Preferably, the shaped portion is rectangular and appropriately the corners are chamfered. In a particularly preferred manner, the shaped portion is square. This shape ensures both simple manufacture and also a particular simple construction of the associated support opening on the support frame. Thus, in this case, the support opening can be in the form of a U, which is open at the top and whose leg length is roughly the same as the edge length of the square. Consequently, the shaped plugs can be fork-mounted. so that in a particularly simple manner a non-rotary mounting is achieved, in which in rapid, simple manner the winding drum can be hung from above in the support frame and is then immediately ready for use without further manipulations or actions.

In a particularly advantageous further development of the invention, the axial length of the tongues of the shaped plug is greater than the axial length of its shaped portion.

The invention also relates to a shaped plug for use in a winding drum according to the invention and which is characterized in that it has a plug portion which is inserted into a receptacle on a butting ring of the winding drum for the creation of a frictionally resistant rotational connection to prevent the unintended rotation of the drum. The plug also has a shaped portion which, on forming the plug connection, projects laterally and axially from the butting ring and is provided with a non-rotationally symmetrical outer profile for the non-rotary mounting in the support opening of a support frame. The plug portion also has radially resilient tongues, which are positioned along a circle concentric to the central axis of the shaped plug. In a particularly preferred manner, the shaped portion is cross-sectionally rectangular, especially square and is made from a thermoplastic material.

BRIEF DESCRIPTION OF THE DRAWINGS

The invention is described in greater detail hereinafter relative to non-limitative embodiments and the attached drawings, which show.

DESCRIPTION OF THE PREFERRED EMBODIMENTS

Figure 1:
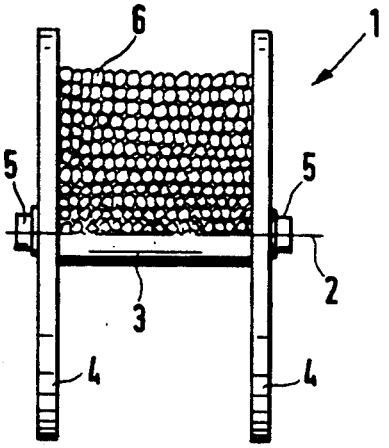
FIG. 1—A view of an inventive winding drum, a chain filling being shown in the upper half.

FIG. 1 shows a winding drum 1 with a central axis 2, a tubular winding shaft 3 and lateral butting rings 4. The top half of FIG. 1 shows the winding drum 1 with a filling by a wound-on chain strand 6, while the bottom half shows it without this filling. On both lateral ends of the winding shaft 3, shaped plugs 5 are non-positively inserted in the particular end opening of the winding shaft 3, as is perspectively shown on a larger scale in FIG. 3. With the shaped plugs 5 inserted, a shaped portion 16 in each case projects axially away from the butting rings 4 and is provided with a non-rotationally symmetrical outer profile 17. In the case of the shaped plugs 5 shown in the drawings, this outer profile 17 has a square cross-section (FIG. 3), the corners of the square being provided with chamfers 18. With the laterally projecting shaped portions 16 of the shaped plugs 5, the winding drum 1 can be hung into a corresponding support opening 7 of a support frame. All the components of the winding drum 1 and the shaped plugs 5 are made from a thermoplastic material.

Figure 2:
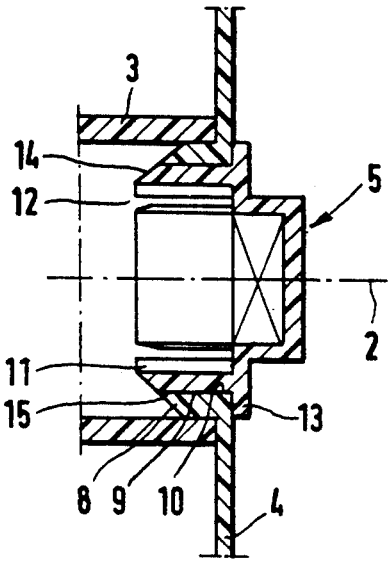
FIG. 2—On a larger scale, a detail section through the insertion area of the shaped plug in the winding shaft.

FIG. 2 is a larger scale detail sectional view of the connecting area between the winding shaft 3, the mounted butting rings 4 and the inserted shaped plugs 5. The butting ring 4 has a central, circular opening and on its edge a circular or ring shoulder 8, directed laterally towards the winding shaft and which has a cylindrical inner face 9 and a cylindrical outer face 10. The winding shaft 3 is located with press fit on the outer circumference of the circular shoulder 8. At one side the shaped plugs 5 are constructed as hollow bodies, as shown by the section in FIG. 2. They are in each case inserted from the side of the butting ring 4 remote from the winding shaft into the inner opening formed in the circular shoulder 8. The receptacle in the butting rings and the shaped plugs 5 are arranged and constructed in the same way on both sides of the winding drum 1.

The part of the shaped plug 5 projecting into the circular shoulder 8 has, in the represented embodiment, four roughly axial spring tongues 11 in the form of circular ring portions (of FIG. 5), which are directed roughly axially and are located on a circular line concentrically around the central axis M—M. Each tongue extends over approximately 83°. Corresponding to the desired non-positive and frictionally resistant seating in the circular shoulder 8, the external diameter, on which are located the ends of the circularly positioned, spring-in tongues 11, is chosen to be somewhat larger than the internal diameter of the circular shoulder 8, so that on insertion into the opening of the shoulder 8, the tongues 11 spring in radially and an elastic pretension is built up, which presses the tongues 11 against the inner face 9 of the receiving bore of the circular shoulder 8. Through an appropriate choice of the spring-in path of the tongues 11 on insertion into the receptacle, it is possible to select or preselect the magnitude of the contact pressure between the tongue and the bore wall and therefore the magnitude of the braking torque with which the frictional forces between the tongues 11 and their reception bore oppose a relative movement of the winding drum 1 with respect to the shaped plugs 5. Considered circumferentially, between the tongues 11 is in each case formed a small slot 12, which allows an unhindered springing out of each tongue 11. The tongues 11 are shaped on a collar 13, which projects radially over the external diameter thereof and limits the insertion path of the shaped plug 5. The free end of the tongues 11 is provided with a bevel 14 inclined towards the longitudinal axis 2 to facilitate the insertion into the opening of the circular shoulder 8. Through an appropriate choice of the tongue thickness and the extension length of the arc of each tongue, the elastic spring-out or spring rigidity of the tongues 11 can be preselected. This spring rigidity determines the magnitude of the contact pressure with which the outer faces 15 of the tongues 11 engage on the inner face 9 of the circular shoulder 8 and consequently the magnitude of the frictional force occurring when the two parts are rotated relative to one another. This makes it possible to fix the magnitude of the braking action of the inserted shaped plugs 5.

Figure 3:
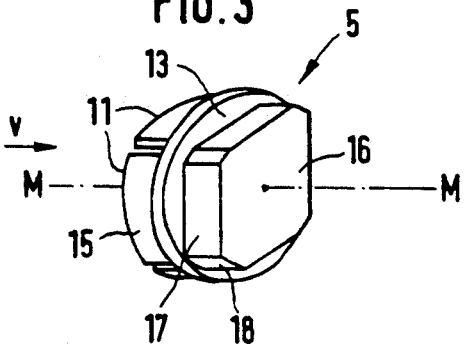
FIG. 3—A perspective view of the shaped plug shown in section in FIG. 2.
Figure 4:
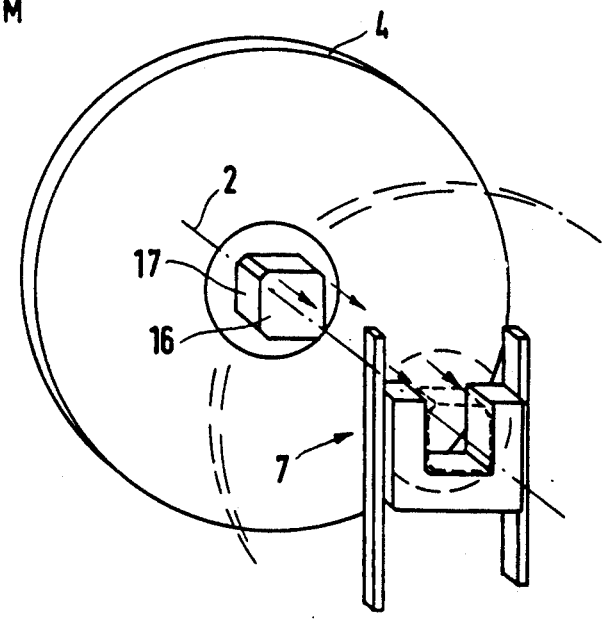
FIG. 4—A perspective view of the association of the end of the winding drum with its support receptacle on the support frame in the non-hung-in state (continuous lines) and in the hung-in state (broken lines).
Figure 5:
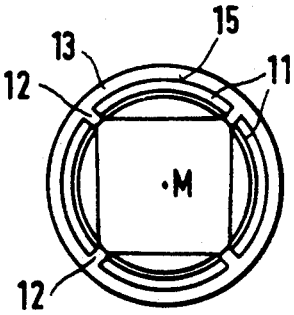
FIG. 5—A view of the inside of the shaped plug according to FIG. 3 (in the viewing direction v in FIG. 3).

The shaped plug 5 is shown perspectively in FIG. 3 and in side view in FIG. 5 (viewing direction v in FIG. 3) it can be clearly seen that the elastic tongues 11 are separated by the collars 13 from the cross-sectionally non-rotationally symmetrical shaped portion 16 of the shaped plug 5, i.e. the shaped portion 16 is connected axially to the other side of the collar 13. When the shaped plug 5 is inserted, the shaped portion 16 projects axially from the butting ring 4 (cf. FIGS. 2 and 4, continuous lines) and can consequently be inserted in a correspondingly shaped support opening 7 on the support frame (FIG. 4, broken lines). For the square outer profile 7 of the shaped portion 16 in the represented embodiment, the support receptacle 7 can be constituted by a forked mounting (cf. FIG. 4) comprising an angular U, which is open at the top and which has leg lengths at least corresponding to the edge length of the square. This support opening 7 ensures a rapid removal or insertion of the shaped portions 16, a reliable non-rotary mounting of the winding drum 1 and is at the same time simple to build up and manufacture.

The winding drum 1 is inserted from above in the fork mounting support 7 and is then secured against dropping out by its own weight. The legs of the U engage on two opposite sides of the square shaped portion 16 and are consequently able to absorb the braking torque which occurs and prevent rotation of the shaped plug 5 with respect to the support frame. In order to remove the winding drum, it is merely necessary to shove it upwards out of the U-shaped support receptacle 7.

The shaped portion 16 of the shaped plug 5 can obviously be given any other shape, which in conjunction with a corresponding support receptacle on the support frame ensures a non-rotary mounting. Thus, e.g. cross-sectionally triangular, polygonal and oval shapes can be used, although then it is not always possible to insert the shaped portion in a top-open support opening, because many of these non-rotationally symmetrical cross-sections lead to closed support opening.

The receptacles on the butting rings 4 can also be in the form of outwardly directed circular shoulders, on which the shaped plugs 5 are engaged. Once again, the circular shoulders are preferably constructed in the form of resilient, projecting tongues, which project into a corresponding inner opening in the shaped plug 5 and are in engagement therein under spring pretension.

The tongues are preferably constructed in one piece with the associated shaped plug from an appropriate thermoplastic material.

While the foregoing description and drawings represent the preferred embodiments of the present invention, it will be obvious to those skilled in the art that various changes and modifications may be made therein without departing from the true spirit and scope of the present invention.

What is claimed is:

1. In a winding drum for a chain strand having a drum, a support frame for supporting the drum and mounting means for rotatably connecting the drum to the support frame, the winding drum having a winding shaft connected between lateral butting rings, and each of the butting rings having a central opening therein, the improvement comprising:

each of the central openings being defined by an inner surface, and said mounting means comprising:

a pair of shaped plugs, each of said plugs inserted within the central opening of a respective butting ring, the drum rotatable with respect to said plugs along an axis of rotation, each of said plugs comprising:

a shaped support engagement portion having an outer profile which prevents rotation of said plug with respect to said support frame when said engagement portion engages the support frame; and resilient spring tongues connected to said shaped portion, said tongues forming axially directed ring portions wherein said tongues act as springs in the direction radial to said axis of rotation, said tongues being inserted within said opening of said respective butting ring, said tongues pressing against said inner surface and preventing the unintended rotation of the winding drum.

2. The winding drum improvement according to claim 1, wherein the shaped plugs and the winding drum are constructed from a plastic material.

3. The winding drum improvement according to claim 1, wherein the shaped plug and the winding drum are constructed from a thermoplastic material.

4. The winding drum improvement according to claim 1, wherein the shaped plugs have the same shape.

5. The winding drum improvement according to claim 1, wherein the inner surface projects within the central opening towards the winding shaft.

6. The winding drum improvement according to claim 1, wherein each shaped plug has four tongues.

7. The winding drum improvement according to claim 6, wherein said tongues are uniformly distributed around a circumference.

8. The winding drum improvement according to claim 7 each of said plugs further comprising a radially projecting circular collar positioned between said support engagement portion and said spring tongues.

9. The winding drum improvement according to claim 6 each of said plugs further comprising a radially projecting circular collar positioned between said support engagement portion and said spring tongues.

10. The winding drum improvement according to claim 1 each of said plugs further comprising a radially projecting circular collar positioned between said support engagement portion and said spring tongues.

11. The winding drum improvement according to claim 1, wherein the shaped support engagement portion has a rectangular cross-section.

12. The winding drum improvement according to claim 11, wherein the shaped support engagement portion has a square cross-section.

13. The winding drum improvement according to claim 12, wherein the corners of the shaped portion are provided with chamfers.

14. The winding drum improvement according to claim 11, wherein the corners of the shaped portion are provided with chamfers.

15. The winding drum improvement according to claim 1, wherein the axial length of the tongues is greater than the axial length of the engagement portion.

* * * * *